US010184258B2

(12) United States Patent
Lagö

(10) Patent No.: US 10,184,258 B2
(45) Date of Patent: Jan. 22, 2019

(54) SPECTATOR HALL AT RACETRACKS AND THE LIKE WITH LOUDSPEAKERS

(71) Applicant: QIRRASOUND TECHNOLOGIES EUROPE AB, Sollentuna (SE)

(72) Inventor: Thomas Lagö, Highland, UT (US)

(73) Assignee: QIRRASOUND TECHNOLOGIES EUROPE AB, Sävsjö (SE)

( * ) Notice: Subject to any disclaimer, the term of this patent is extended or adjusted under 35 U.S.C. 154(b) by 0 days.

(21) Appl. No.: 15/643,971

(22) Filed: Jul. 7, 2017

(65) Prior Publication Data

US 2018/0155943 A1 Jun. 7, 2018

Related U.S. Application Data

(60) Provisional application No. 62/359,434, filed on Jul. 7, 2016.

(51) Int. Cl.

| | |
|---|---|
| ***E04B 1/82*** | (2006.01) |
| ***E04H 3/12*** | (2006.01) |
| ***H04R 1/02*** | (2006.01) |

(52) U.S. Cl.

CPC ..... *E04H 3/12* (2013.01); *E04B 1/8209* (2013.01); *H04R 1/025* (2013.01); *E04B 2001/8263* (2013.01)

(58) Field of Classification Search

CPC .. E04H 3/12; E04B 1/8209; E04B 2001/8263
USPC ..... 52/6, 7, 8, 9, 10
See application file for complete search history.

(56) References Cited

U.S. PATENT DOCUMENTS

| | | | | | |
|---|---|---|---|---|---|
| 2,701,025 | A * | 2/1955 | Kuhl | H04R 1/26 | 181/146 |
| 3,087,578 | A * | 4/1963 | Reed | B41J 29/08 | 181/201 |
| 6,006,476 | A * | 12/1999 | Zarnick | E04B 1/994 | 52/144 |
| 6,418,670 | B1 * | 7/2002 | Kuranov | A63J 1/02 | 472/75 |
| 6,915,610 | B2 * | 7/2005 | Stark, III | E04H 3/10 | 52/144 |
| 6,920,658 | B1 * | 7/2005 | Miraglia | E01D 1/00 | 14/69.5 |
| 8,978,816 | B2 * | 3/2015 | Slotznick | E04B 1/99 | 181/30 |
| 2003/0037490 | A1 * | 2/2003 | Stark, III | E04H 3/10 | 52/6 |
| 2016/0002939 | A1 * | 1/2016 | Monacchi | E04H 3/22 | 52/6 |
| 2017/0224950 | A1 * | 8/2017 | Lutz | A61M 21/00 | |

* cited by examiner

*Primary Examiner* — Rodney Mintz
(74) *Attorney, Agent, or Firm* — Birch, Stewart, Kolasch & Birch, LLP

(57) ABSTRACT

A spectator hall at racetracks includes a roof with an inner ceiling decreasing in height from the racetrack, an opening directed to the racetrack, a back wall, a number of seats arranged with increasing height from the racetrack, at least one loud speaker at the ceiling near the opening, and an invisible front wall covering the opening. The invisible front wall is made from a stable material like glass or acrylic polymer, and is mounted stiffly e g by stiffening bars.

10 Claims, 1 Drawing Sheet

Prior Art

SPECTATOR HALL AT RACETRACKS AND THE LIKE WITH LOUDSPEAKERS

The present invention relates to a spectator hall at racetracks and the like with loudspeakers. Most such halls have a high sound levels. The interesting fact is, that the design of common halls is such, that they will act like a "sound amplifier" or "microphone" which is obvious when looking at the enclosed FIG. 1. In this figure, a section of a common spectator hall is depicted. A race track is denoted by 1, a basic structure by 2. Supports 3, 4 and 5, carry a roof 6, inclining to a back wall 7. Seats 8, are arranged at increasing levels from the front 9, of the hall. There is a fence 10 between the racetrack 1 and the hall. One of more loudspeakers 11 is shown at the ceiling. It is obvious, that the sound from the racetrack will be amplified in the seating areas. The outside air has an acoustic impedance $Z_1$, and the inner impedance in the hall has impedance $Z_2$. The opening of the hall will act like an "impedance transformer" and allow the sound to easily travel into the seating area with little losses. Compare this to the exponential horn that is an impedance transformer for loudspeakers. Reciprocity rains and the "horn" will act like "a microphone" for the seating area. Also, the loud speaker up at the ceiling has challenges fighting the external sound that couples well to inner area, and will also project poorly due to the impedance difference. The impedance transformer is trying to "reject the sound" this sound, not allowing it. The complete design is wrong according to impedance theory in acoustics. Hence, the sound levels are very high in the seating area and it is almost impossible to hear what is being said by the speaker voices.

DETAILED DESCRIPTION OF THE PREFERRED EMBODIMENTS

Figure 1:
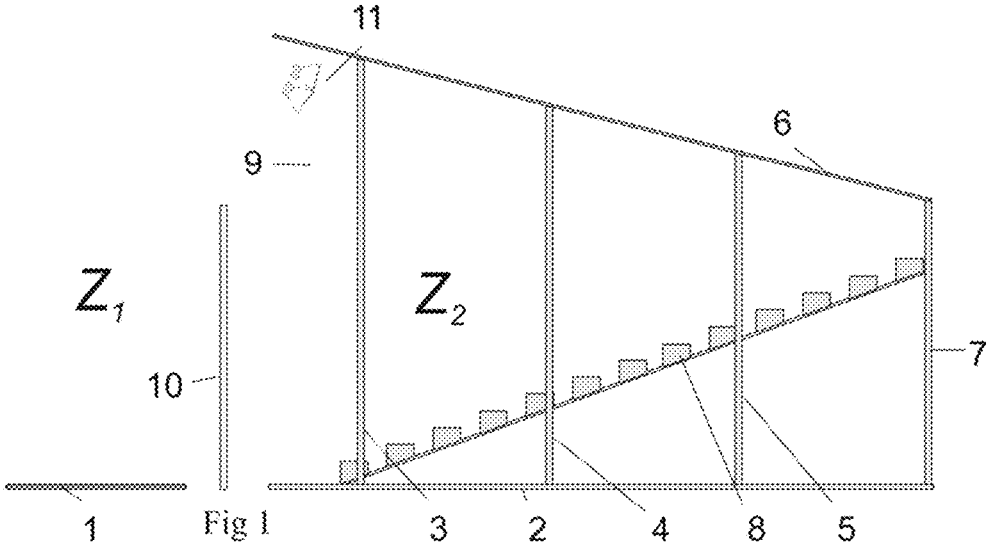
FIG. 1 is a section of a common spectator hall.
Figure 2:
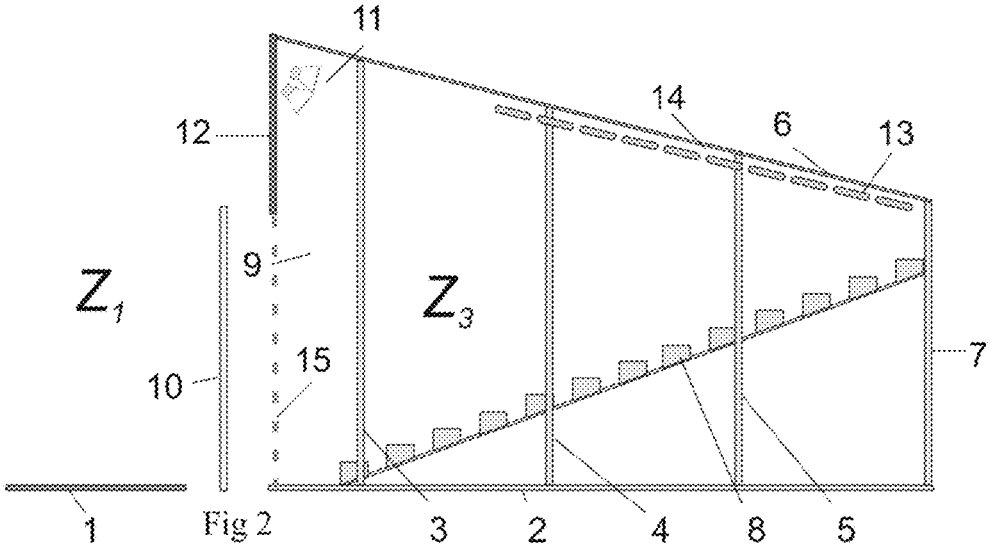
FIG. 2 is a section of a spectator hall according to the present invention.

According to the invention, an improved design is shown in FIG. 2. In this reference numbers 1-11 show the same details as in FIG. 1. A transparent wall 12, preferably consisting of double glass or plastic, like acrylic polymer is mounted stiffly, e g by stiffening bars, making sure the wall does not radiate sound. This transparent wall should be mounted as low as possible, still giving the spectators a good view of the event. The incoming sound wave with an outside impedance Z1 will have challenges going into the new inner impedance $Z_3$. The sound that will be reflected ($R_S$) in this "invisible wall," created by the wall 12, is given by:

$$R_S=(Z_1-Z_3)/Z_1+Z_3)$$

Since the impedance difference is rather large between $Z_1$ and $Z_3$ due to the arrangement, the sound loose energy (a large part is reflected) when travelling into the seating area. This will create a substantial damping by itself and will help decrease the sound exposure on the visitors from the outside sound.

A further improvement of the spectator hall according to the invention is to arrange some damping material 13 at the inner ceiling 14, about ⅔ of the ceiling length from the back wall 7. Preferably absorption panels shall be mounted separated from each other with some air space from the ceiling, 2-5 inches is a good choice. This arrangement will further change the impedance for $Z_3$, and will also minimize the reflections and sound built up inside the seating area.

A further improvement is to mount loudspeakers 11 at the limit between the wall 12, and the ceiling (14). This will project the sound and create a "horn" that will amplify the sound inside the seating area, and the impedance transformer is now pointing in the correct direction.

The combined improvements will help creating a much better intelligibility and lower the harmful sound exposure to spectators. Today, the situation is both terrible and harmful. The solution is rather low cost and can be retrofitted and implemented at most race spectator seating areas and other similar venues.

The invention claimed is:

1. A spectator hall, comprising:

a hall front;

a rear wall spaced from the hall front in a first direction;

a floor with increasing height from the hall front to the rear wall;

a plurality of rows of seats located on the floor;

a transparent front wall having a bottom edge spaced from the floor to form an opening between the bottom edge of the front wall and the floor;

a ceiling extending from a rear edge at the rear wall, the ceiling having a front edge spaced from the rear edge by a first distance; and soundproofing material positioned on the ceiling extending from the rear edge of the ceiling, a front edge of the soundproofing material being spaced from the front edge of the ceiling to form an exposed portion of the ceiling.

2. The spectator hall according to claim 1, wherein the exposed portion of the ceiling is about one third of the first distance.

3. A spectator hall at racetracks, comprising:

a roof with an inner ceiling decreasing in height from the racetrack;

an opening directed to the racetrack;

a back wall;

a floor arranged with increasing height from the racetrack;

a plurality of rows of seats located on the floor;

at least one loud speaker located at the ceiling near the opening; and a transparent front wall covering an upper part of the opening, said transparent front wall being made from a stable material and having a bottom edge spaced from the floor, wherein damping material is arranged at the inner ceiling, said damping material covering about ⅔ of a ceiling length from the back wall.

4. The spectator hall at racetracks according to claim 3, wherein the at least one loud speaker is mounted at a junction between the transparent front wall and the ceiling.

5. The spectator hall at racetracks according to claim 3, wherein the at least one loud speaker is mounted at a junction between the transparent front wall and the ceiling.

6. The spectator hall at racetracks according to claim 3, wherein the at least one loud speaker is mounted at a junction between the transparent front wall and the ceiling.

7. The spectator hall at racetracks according to claim 3, wherein said transparent front wall is made from glass or acrylic polymer.

8. The spectator hall at racetracks according to claim 3, wherein absorption panels are mounted separated from each other with air space from the ceiling.

9. The spectator hall at racetracks according to claim 8, wherein the at least one loud speaker is mounted at a junction between the transparent front wall and the ceiling.

10. The spectator hall at racetracks according to claim 8, wherein said air space from the ceiling is 2-5 inches.

* * * * *